US009469937B2

(12) United States Patent
Ko et al.

(10) Patent No.: US 9,469,937 B2
(45) Date of Patent: Oct. 18, 2016

(54) TEXTILE SHEET FOR CLOTHES FOR RADIATING BIOACTIVE ENERGY

(71) Applicant: VENTEX CO., LTD., Seoul (KR)

(72) Inventors: Kung Chan Ko, Yongin-si (KR); Gwang Wung Yang, Seongnam-si (KR); Yong Hwan Rho, Incheon (KR); Eun Ho Park, Seoul (KR)

(73) Assignee: VENTEX CO., LTD., Seoul (KR)

( * ) Notice: Subject to any disclaimer, the term of this patent is extended or adjusted under 35 U.S.C. 154(b) by 0 days.

(21) Appl. No.: 14/119,323

(22) PCT Filed: Aug. 12, 2013

(86) PCT No.: PCT/KR2013/007241
§ 371 (c)(1),
(2) Date: Nov. 21, 2013

(87) PCT Pub. No.: WO2014/185590
PCT Pub. Date: Nov. 20, 2014

(65) Prior Publication Data

US 2016/0076195 A1 Mar. 17, 2016

(30) Foreign Application Priority Data

May 15, 2013 (KR) ..... 10-2013-0055123

(51) Int. Cl.
*B41M 1/16* (2006.01)
*B41M 5/30* (2006.01)
*D06M 16/00* (2006.01)
(Continued)

(52) U.S. Cl.
CPC ..... *D06N 3/0063* (2013.01); *B41M 1/26* (2013.01); *B41M 5/30* (2013.01); *B41M 5/41* (2013.01); *B41M 5/42* (2013.01); *D06M 11/00* (2013.01); *D06M 11/38* (2013.01); *D06M 11/44* (2013.01); *D06M 11/45* (2013.01); *D06M 11/79* (2013.01); *D06M 11/83* (2013.01); *D06M 15/263* (2013.01); *D06N 3/042* (2013.01); *D06P 1/004* (2013.01); *A41D 31/02* (2013.01); *A41D 2400/32* (2013.01); *B41M 2205/38* (2013.01);
(Continued)

(58) Field of Classification Search
CPC ..... B41M 1/26; B41M 5/30; D06M 16/00; Y10T 442/2525
USPC ..... 503/227, 206; 442/123
See application file for complete search history.

(56) References Cited

U.S. PATENT DOCUMENTS 6,228,804 B1 * 5/2001 Nakashima ..... C09K 9/02 503/201
6,607,994 B2 * 8/2003 Linford ..... D06M 16/00 428/402
(Continued)

FOREIGN PATENT DOCUMENTS

JP 2002-038370 * 2/2002 ..... D06M 11/77

*Primary Examiner* — Bruce H Hess
(74) *Attorney, Agent, or Firm* — Polsinelli PC

(57) ABSTRACT

Disclosed herein is a textile sheet for clothes for radiating bioactive energy. The textile sheet for clothes according to the present invention comprises a bioactive-energy radiating layer formed by coating bioactive radiant materials of silicon oxide, magnesium, aluminum, sodium, calcium, and oxidized metal, and a thermochromic unit discolored at a predetermined temperature on a surface of the bioactive-energy radiating layer and formed on a part of the bioactive-energy radiating layer. Accordingly, the textile sheet for clothes according to the present invention is capable of reducing reactive oxygen and improving blood flow.

9 Claims, 5 Drawing Sheets

(51) Int. Cl.

| | |
|---|---|
| ***D06N 3/00*** | (2006.01) |
| ***B41M 1/26*** | (2006.01) |
| ***D06M 11/83*** | (2006.01) |
| ***D06M 11/38*** | (2006.01) |
| ***D06M 11/44*** | (2006.01) |
| ***D06M 11/45*** | (2006.01) |
| ***D06M 11/79*** | (2006.01) |
| ***D06P 1/00*** | (2006.01) |
| ***D06M 11/00*** | (2006.01) |
| ***D06M 15/263*** | (2006.01) |
| ***B41M 5/41*** | (2006.01) |
| ***B41M 5/42*** | (2006.01) |
| ***D06N 3/04*** | (2006.01) |
| *A41D 31/02* | (2006.01) |

(52) U.S. Cl.
CPC ..... *D10B 2331/04* (2013.01); *D10B 2501/00* (2013.01); *D10B 2509/00* (2013.01)

(56) References Cited

U.S. PATENT DOCUMENTS

| | | | | |
|---|---|---|---|---|
| 7,250,174 | B2 * | 7/2007 | Lee | A61K 8/22 424/400 |
| 7,674,747 | B1 * | 3/2010 | Long | D06P 1/004 503/201 |
| 2006/0159907 | A1 * | 7/2006 | Percec | D01D 5/11 428/315.5 |
| 2009/0022974 | A1 * | 1/2009 | Lee | A01N 59/16 428/304.4 |
| 2009/0186759 | A1 * | 7/2009 | Lin | B41M 7/0027 503/215 |

* cited by examiner

TEXTILE SHEET FOR CLOTHES FOR RADIATING BIOACTIVE ENERGY

CROSS REFERENCE TO RELATED APPLICATIONS

This application is a National Phase filing under 35 U.S.C. §371 of PCT/KR2013/007241 filed on Aug. 12, 2013; and this application claims priority to Application No. 10-2013-0055123 filed in Republic of Korea on May 15, 2013, under 35 U.S.C. §119; the entire contents of all are hereby incorporated by reference.

TECHNICAL FIELD

The present invention relates to a textile sheet for clothes for radiating bioactive energy, and more particularly to a textile sheet for clothes for radiating bioactive energy capable of containing various kinds of inorganic materials for radiating bioactive energy good for health in the textile sheet.

BACKGROUND ART

With improved standard of livings, there have been expectations about functional fabrics having comfortable, refreshable, and aesthetic. Various yarns and fabrics have been introduced to meet these demands.

The above high-performance, multi-functional yarns and fabrics have been widely used in the field of general clothes as well as sports clothes such as climbing, leisure, and so forth.

Typical examples of functional fabrics are absorbing fabrics, moisture-controlling fabrics, temperature-controlling fabrics like heating or cooling, energy-radiating fabrics (e.g., radiating far-infrared ray or anion), and fabrics for curing or alleviating illness.

Among them, the moisture-controlling fabrics have been rapidly developed with manufacturing technology of fabrics, knitting, and non-woven fabrics. Also, the temperature-controlling fabrics have been improved by containing or printing newly functional materials in/on fabrics.

However, there have been difficulties to improve energy-radiating fabrics. The reason for this is that most of their materials are inorganic substances, so that touch can be damaged and easily left.

Korean Patent No. 0254945 discloses technique for coating elvan and bactericides on fabrics. However, its disadvantage is that disclosed functions are eliminated in laundering fabrics using bleaching agent or detergent.

DISCLOSURE

Technical Problem

The present invention has been made in an effort to solve the above problems, and it is an object of the present invention to provide a textile sheet for clothes for radiating bioactive energy good for health.

It is another object of the present invention to provide a textile sheet for clothes for radiating bioactive energy capable of preventing lactic acid from being produced, increasing muscular endurance, and blood flow.

It is still another object of the present invention to provide a textile sheet for clothes for radiating aesthetic bioactive energy capable of sensing body temperature to apprehend body condition.

It is still another object of the present invention to provide a textile sheet for clothes for radiating having various functions to be suitable for training clothes or working clothes.

Technical Solution

Pursuant to embodiments of the present invention, a textile sheet for clothes for radiating bioactive energy comprises a bioactive-energy radiating layer formed by coating bioactive radiant materials of silicon oxide, magnesium, aluminum, sodium, calcium, and oxidized metal, and a thermochromic unit discolored at a predetermined temperature on a surface of the bioactive-energy radiating layer and formed on a part of the bioactive-energy radiating layer.

Pursuant to embodiments of the present invention, the bioactive radiant materials of silicon oxide, magnesium, aluminum, sodium, calcium, and oxidized metal is mixed with a binder to be coated.

Pursuant to embodiments of the present invention, the binder is an acrylic-based binder.

Pursuant to embodiments of the present invention, the bioactive radiant materials are coated at 5% to 40% weight of the textile sheet.

Pursuant to embodiments of the present invention, the silicon oxide, magnesium, aluminum, sodium, calcium, and oxidized metal is included in the bioactive radiant materials over as much as 0.5 weight %, respectively.

Pursuant to embodiments of the present invention, the thermochromic unit is formed in a shape of wave, dot, stripe, or a predetermined design.

Pursuant to embodiments of the present invention, the thermochromic unit has the same color as the thermochromic unit and discolored at a temperature of 10° C. to 30° C. to have different color from the bioactive-energy radiating layer.

Pursuant to embodiments of the present invention, the thermochromic unit has different color from the thermochromic unit and discolored at a temperature of 10° C. to 30° C. to have the same color as the bioactive-energy radiating layer.

Advantageous Effects

According to the present invention, a textile sheet for radiating bioactive energy radiates bioactive energies good for health to produce lactic acid smaller when users wear general clothing in working out or recovering, thereby causing relatively low muscle fatigue.

Also, a textile sheet for radiating bioactive energy according to the present invention is capable of smoothing blood flow by dissolving rouleau formation within blood and preventing aging by hindering active oxygen.

Further, a textile sheet for radiating bioactive energy according to the present invention can rapidly recover conditions of boy organs such as limp, lung, large intestine, nerve, circulation, allergy, organ degeneration, merdian systems, heart, small intestine, and so forth.

<Brief explanation of essential parts of the drawings>

| | |
|---|---|
| 10: Textile sheet, | 100: Bioactive-energy radiating layer |
| 200: Thermochromic unit | |

BEST MODE

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

As used herein, the terms "about", "substantially", etc. are intended to allow some leeway in mathematical exactness to account for tolerances that are acceptable in the trade and to prevent any unconscientious violator from unduly taking advantage of the disclosure in which exact or absolute numerical values are given so as to help understand the invention.

As utilized herein, the term "fabric" is intended to include articles produced by weaving or knitting, non-woven fabrics, fiber webs, and so forth.

Figure 1:
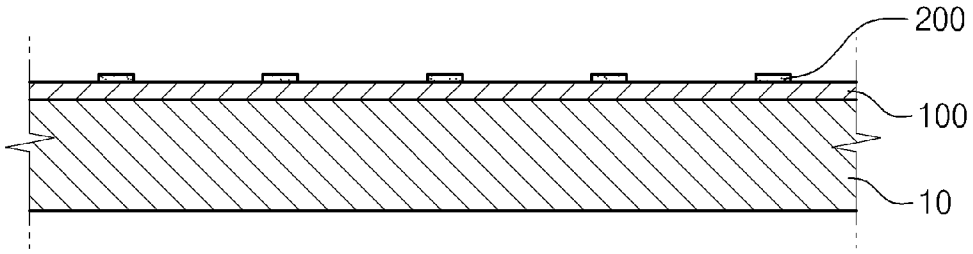
FIG. 1 is a cross-sectional view of a textile sheet for clothes for radiating bioactive energy according to the present invention.
Figure 2:
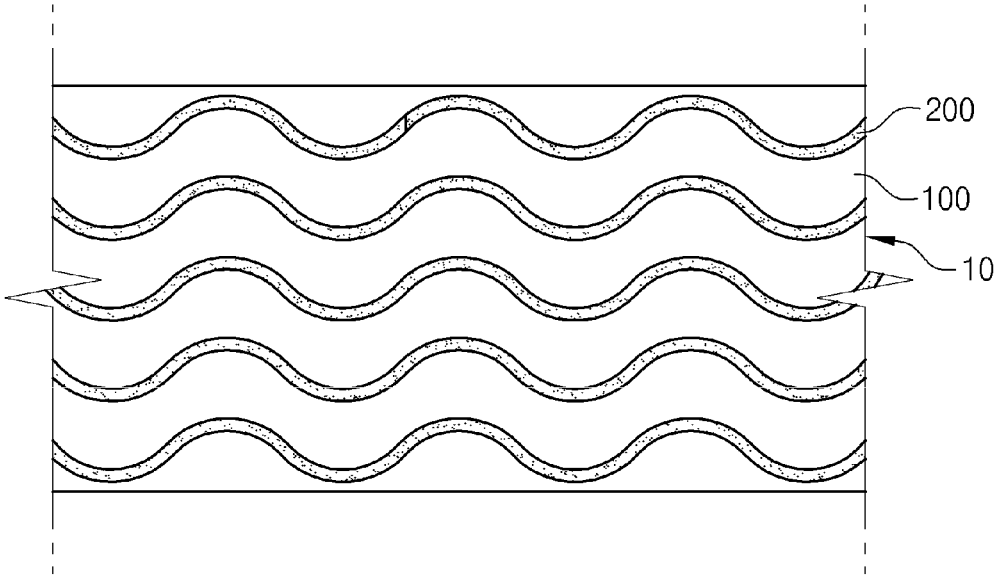
FIG. 2 is a first embodiment of a thermochromic unit of a textile sheet for clothes for radiating bioactive energy according to the present invention.
Figure 3:
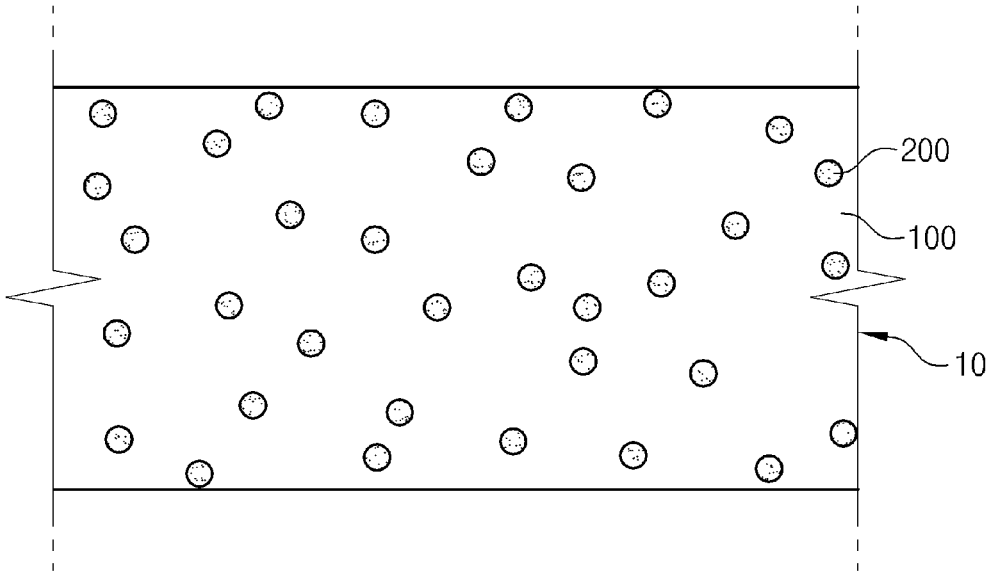
FIG. 3 is a second embodiment of a thermochromic unit of a textile sheet for clothes for radiating bioactive energy according to the present invention.
Figure 4:
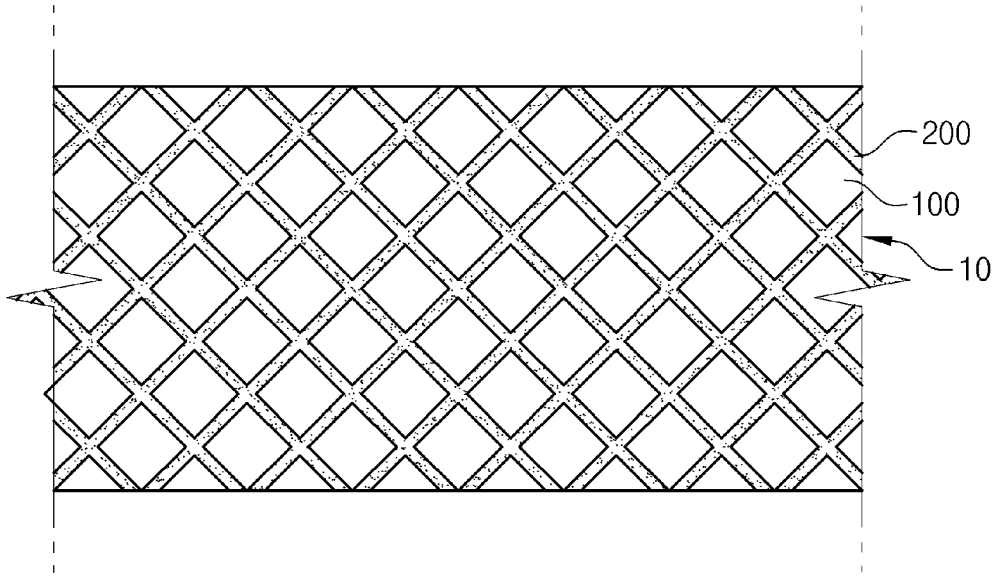
FIG. 4 is a third embodiment of a thermochromic unit of a textile sheet for clothes for radiating bioactive energy according to the present invention.
Figure 5:
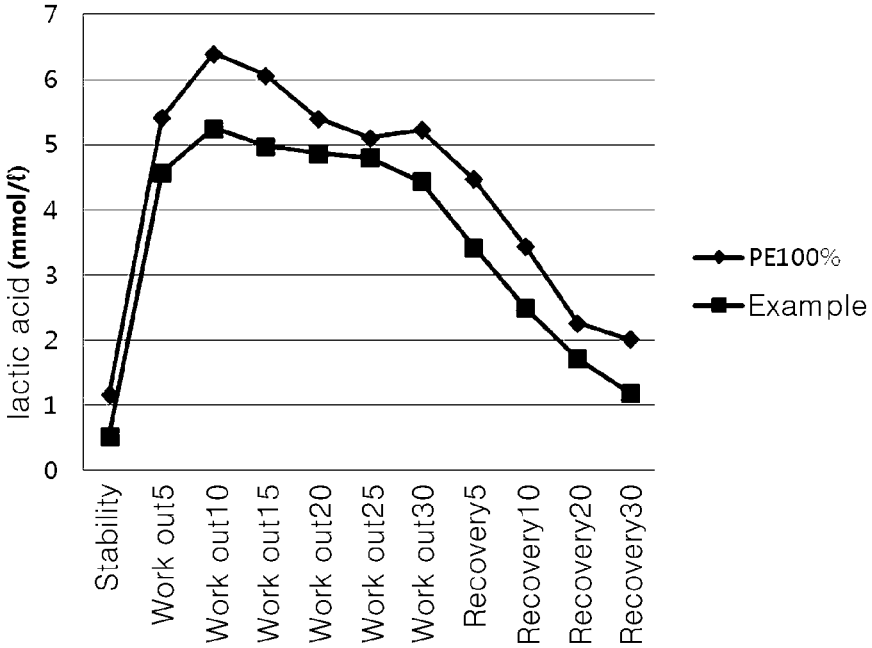
FIG. 5 is a graph illustrating measurement result of lactic acid of a textile sheet for clothes for radiating bioactive energy according to the present invention.
Figure 6:
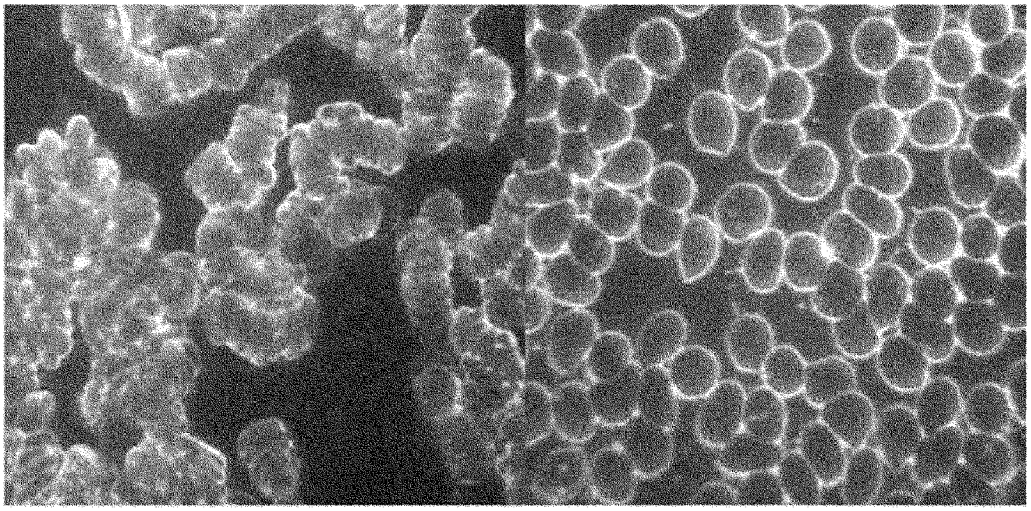
FIG. 6 is a picture showing measurement result of micro-blood-flow of a textile sheet for clothes for radiating bioactive energy according to the present invention.
Figure 7:
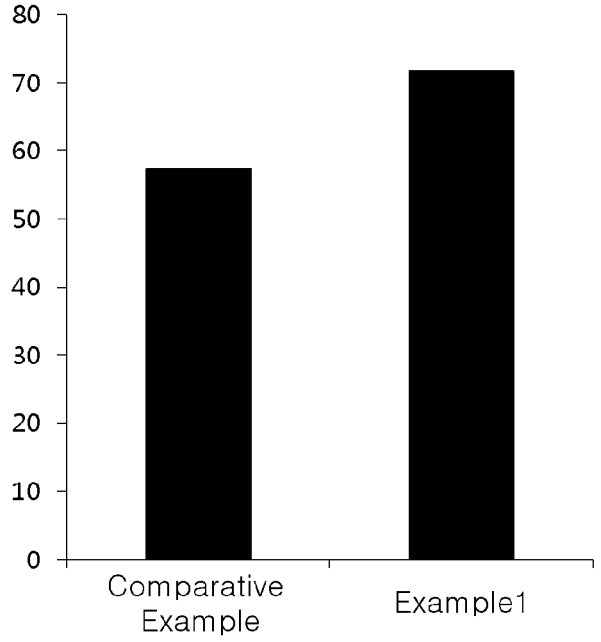
FIG. 7 is a picture showing measurement result of muscular endurance of a textile sheet for clothes for radiating bioactive energy according to the present invention.
Figure 8:
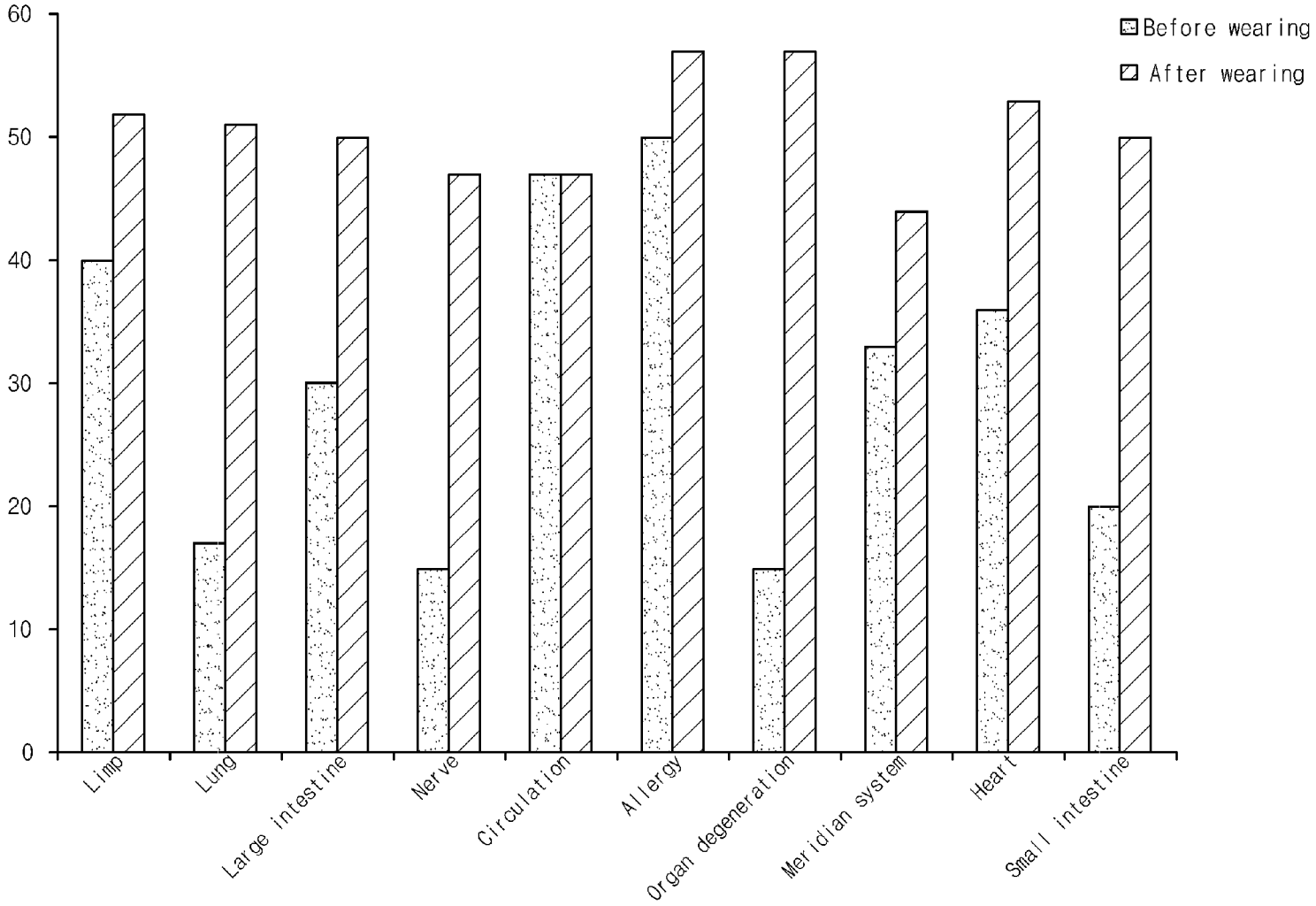
FIG. 8 is a graph illustrating measurement result of EVA of a textile sheet for clothes for radiating bioactive energy according to the present invention.

FIG. 1 is a cross-sectional view of a textile sheet for clothes for radiating bioactive energy according to the present invention. FIG. 2 is a first embodiment of a thermochromic unit of a textile sheet for clothes for radiating bioactive energy according to the present invention. FIG. 3 is a second embodiment of a thermochromic unit of a textile sheet for clothes for radiating bioactive energy according to the present invention. FIG. 4 is a third embodiment of a thermochromic unit of a textile sheet for clothes for radiating bioactive energy according to the present invention. FIG. 5 is a graph illustrating measurement result of lactic acid of a textile sheet for clothes for radiating bioactive energy according to the present invention. FIG. 6 is a picture showing measurement result of micro-blood-flow of a textile sheet for clothes for radiating bioactive energy according to the present invention. FIG. 7 is a picture showing measurement result of muscular endurance of a textile sheet for clothes for radiating bioactive energy according to the present invention. FIG. 8 is a graph illustrating measurement result of EVA of a textile sheet for clothes for radiating bioactive energy according to the present invention.

As shown in FIGS. 1 to 4, the present invention relates to a textile sheet for clothes for radiating bioactive energy 10 formed by sequentially stacking a bioactive-energy radiating layer 100 and a thermochromic unit 200 on a surface of the textile sheet 10

Bioactive-energy radiant materials have intrinsic energy according to molecular structure and atom vibration to transfer energy to body. This energy provides stimulation to body, helps blood circulation, increase oxygen in blood, and increases vitality to body.

Such bioactive energy transfers energy to a muscle layer, thereby activating movement as well as reducing fatigability of muscles.

The bioactive-energy radiating layer 100 is formed by coating the bioactive-energy radiant materials such as silicon oxide, magnesium, aluminum, sodium, calcium, and oxidized metal. In this case, the silicon oxide performs a function to remove wastes and sebum in skin pores. The magnesium helps excretion palpation of wastes and collagen combination.

Additionally, the aluminum improves blood circulation, the sodium helps osmotic pressure in vivo and moisture controlling smoothly. The calcium helps detoxification of body and oxidized metal-collagen combination.

The bioactive-energy radiant materials such as silicon oxide, magnesium, aluminum, sodium, calcium, and oxidized metal are mixed with the binder to be coated on one side of the textile sheet to form the bioactive-energy radiating layer 100.

The binder used in the textile sheet is applicable, and acrylic-based binder, silicon-based binder, and polyurethane-based binder is applicable. Among the binders, it is preferable that the acrylic-based binder is used because it is easy to use and does not provide skin stimulation.

If the bioactive-energy radiant materials forming the bioactive-energy radiating layer 100 are coated less than 5% of the textile sheet weight, their function may be declined. Unlike this, if they are coated exceeding 40% of the textile sheet weight, their function is a little increased and cost becomes high. Accordingly, it is preferable that the bioactive-energy radiant materials are coated in 5% to 40% of the textile sheet weight.

For smoothly performing the functions of silicon oxide, magnesium, aluminum, sodium, calcium, and oxidized metal, it is preferable that they are coated more than 0.5 weight % in the bioactive-energy radiant materials, respectively.

The bioactive-energy radiant materials may add various functional materials such as plant extracts, bactericides besides silicon oxide, magnesium, aluminum, sodium, calcium, and oxidized metal.

The thermochromic unit 200, as shown in FIG. 1, is formed on the bioactive-energy radiating layer 100 to immediately know aesthetic and wearing condition of the textile sheet for clothes for radiating bioactive energy. The thermochromic unit 200 may be formed in various shapes of wave of FIG. 2, dot of FIG. 3, stripe of FIG. 4, designed patterns, and the like.

The thermochromic unit 200 may be formed of a temperature-sensitive color changing pigment. The temperature-sensitive color changing pigment is a pigment for revealing color in a specific temperature. If this pigment absorbs heat, its composition structure is changed to develop color or de-color. To the contrary, if the pigment blocks heat, its composition structure is reversed into original composition structure to de-color or develop color. Generally, raw materials of such temperature-sensitive color changing pigment is electron-donating orthochromatism organic composition and is consist of a donor for emitting electron and an acceptor for receiving electron. By interaction of these elements, the raw materials reveal color in crystalline structure. If heat is applied, the acceptor is separated and interaction is not performed, so that color is disappeared.

The temperature-sensitive color changing pigment comprises the electron-donating orthochromatism organic composition and electron acceptor composition. It is sensitive to external environment, and particularly very sensitive to oxygen and humidity. Thus, it is preferably used by coating low temperature thermoplastic resin. Through micro encapsulation process, it is preferably used as micro-capsule type.

The thermochromic unit 200 may be formed by mixing the temperature-sensitive color changing pigment and a binder through padding or printing.

The thermochromic unit 200 is as a component for giving aesthetic to the textile sheet for clothes for radiating bioactive energy and may have various functions.

For example, the thermochromic unit 200 is formed having the same color as the bioactive-energy radiating layer 100 and designed to be discolored at a temperature of 10° C. to 30° C. being neighboring surface temperature of body to have different color from the bioactive-energy radiating layer 100.

As another example, the thermochromic unit 200 is formed having different color from the bioactive-energy radiating layer 100 and designed to be discolored at a temperature of 10° C. to 30° C. being neighboring surface temperature of body to have the same color as the bioactive-energy radiating layer 100.

As mentioned above, the thermochromic unit 200 is designed to be discolored at temperature of 10° C. to 30° C. being neighboring surface temperature of body, so that the thermochromic unit 200 is discolored according to wearing condition to give aesthetic.

It is preferable that the temperature-sensitive color changing pigment may include compound having ester group, compound having alcohol group, and compound having amide group to be discolored at a temperature similar to body temperature.

MODE FOR INVENTION

Hereinafter, while this invention has been described in connection with what is presently considered to be the most practical and preferred embodiment, it is to be understood that the invention is not limited to the disclosed embodiment.

EXAMPLE

A bioactive-energy radiating material was formed by mixing silicon oxide of 10 weight %, magnesium of 10 weight %, aluminum of 10 weight %, sodium of 10 weight %, calcium of 10 weight %, oxidized metal of 10 weight %, and quaternary ammonium-based bactericides of 40 weight %. A bioactive-energy radiating layer was formed by mixing the bioactive-energy radiating material with acrylic-based binder in a ratio of 1:1 through roll printing method on a surface of a textile sheet formed of polyester.

A thermochromic unit was formed on the bioactive-energy radiating layer as shown in FIG. 2 to manufacture a textile sheet for clothes for radiating bioactive energy.

The thermochromic unit was formed by mixing temperature-sensitive color changing pigment discolored at a temperature of 20° C. and acrylic-based binder through a conventional printing.

After manufacturing clothes using the textile sheet for clothes for radiating bioactive energy according to the present invention, the effectiveness thereof was tested in various ways.

1. Measurement of Lactic Acid

A. Place: Sports/leisure textile research center of In-ha University.

B. Method: After users wore clothes before 24 hours of the test, lactic acid secretion was measured for 30 minutes after working out and 30 minutes during recovery.

Clothes manufactured by polyester fabrics as a comparative example using the same condition was tested and compared to an example.

C. Result: The result of measuring lactic acid was shown in FIG. 5.

Lactic acid was created through hydrolyzing glycogen being energy source in the body by muscles. Glycogen is made and stored primarily in the cells of the liver and the muscles, and functions as the secondary long-term energy storage, and provides rapidly stored glucose when body urgently needs glucose. In the example of the present invention, we have found that the amount of lactic acid secretion was relatively small during working out and recovery as comparison with wearing condition.

2. Observation the Amount of Blood Flow (Observation of Red Blood Cell)

A. Place: Sports/leisure textile research center of In-ha University.

B. Method: After users wore clothes before 24 hours of the test, red blood cell flow was observed.

Clothes manufactured by polyester fabrics as a comparative example using the same condition was tested and compared to an example.

C. Result: The result of measuring lactic acid was shown in FIG. 5.

Lactic acid was created through hydrolyzing glycogen being energy source in the body by muscles. Glycogen is made and stored primarily in the cells of the liver and the muscles, and functions as the secondary long-term energy storage, and provides rapidly stored glucose when body urgently needs glucose. In the example of the present invention, we have found that the amount of lactic acid secretion was relatively small during working out and recovery as comparison with wearing condition.

Clothes manufactured by polyester fabrics as a comparative example using the same condition was tested and compared to an example.

C. Result: The result of observing red blood cell was shown in FIG. 6. In FIG. 6, left represents the red blood cell of comparative example, and the right represents those of example.

In Rouleaux Formation, when there is γ-globulin blood disease, red blood cells do not be distributed on smer sample-blood but appeared to be overlapped such that stocked moneys are scattered. This is a diagnosis standard of micro-globulin blood disease or myeloma.

As can be seen from FIG. 6, the bioactive energy according to the present invention disassembles Rouleaux Formation to help blood circulation.

3. Measurement of Muscle Endurance

A. Place: Laboratory of Ventex Co., Ltd.

B. Method: After users wore clothes before 72 hours of the test, they continuously worked out in order that their muscles have constant speed and strength.

Clothes manufactured by polyester fabrics as a comparative example using the same condition was tested and compared to an example.

C. Result: The result of measuring muscle endurance was shown in FIG. 7.

As can be seen from FIG. 7, we have found that the muscle endurance was raised in the example in comparison with the comparative example. Accordingly, the working-out and vocation ability can be improved in the example in comparison with the comparative example.

4. Measurement of Active Oxygen Amount

A. Place: Laboratory of Ventex Co., Ltd.

B. Method: After users wore clothes before 72 hours of the test, the amount of active oxygen was measured. Each of active oxygen amounts of men and women was measured. The number of men and women as object of experiment were four, respectively.

Clothes manufactured by polyester fabrics as a comparative example using the same condition was tested and compared to an example.

C. Result: The result of measuring active oxygen amounts was shown in Table 1.

Active oxygen is generic term of oxygen compound having electron being not pairs. It is unstable and tends to be stable by reacting surrounding materials to give or take away electrons (oxidation process). This reaction causes aging and illness.

As can be seen from Table 1, we have found that active oxygen occurrence was reduced in all objects of experiment in the example in comparison with the comparative example. Accordingly, the risk element causing illness such as cancer, aging, liver and bowels, stomach and intestines disease, artery hardening, heart, cerebropathia, diabetes, atopic dermatitis, proliferative arthritis can be dramatically reduced.

TABLE 1

| | Comparative Example | Example |
|---|---|---|
| Men 1 | 312 | 273 |
| Men 2 | 327 | 304 |
| Men 3 | 374 | 355 |
| Men 4 | 375 | 366 |
| Women 1 | 360 | 328 |
| Women 2 | 361 | 338 |
| Women 3 | 311 | 279 |
| Women 4 | 279 | 268 |

5. Measurement of EVA (Electroacupuncture According to Voll)

A. Place: Germany Germacolor Laboratory.

B. Method: After users wore clothes before 45 minutes of the test, the amount of active oxygen was measured. Each of active oxygen amounts of men and women was measured. The number of men and women as object of experiment were four, respectively.

C. Measuring Equipment: M.L. Kindling GmbH, Germany Tyo-Akuport M2 (Medical device authorization code: DIN EN ISO 13485:2007)

Clothes manufactured by polyester fabrics as a comparative example using the same condition was tested and compared to an example.

D. Result: The result of measuring active oxygen amounts was shown in FIG. 8.

EVA is an electro-physiology device by connecting oriental merdian theory and anatomy. The purpose of E.A.V. is to establish an Energetic Evaluation, a Functional Testing of organs and tissues through the measure of Acupuncture and electro-acupuncture points in order to determine energetically unbalanced points.

The conductance (capacity to let the stimulation current through) of an organ or a tissue is measured in order to discover energetically unbalanced points knowing that the energetic equilibrium of the human organism is altered, among other things, by the negative ambiance influence exercised by some medications, poisons, insecticides, viruses, bacteria, harmful electromagnetic fields and inflammations as well as certain aliments. The body is the emitting and receiving focus of electromagnetic messages. Cells, as well as the entire organism, constitute what is called in electronics an oscillatory circuit that is capable, if it is submitted to electromagnetic waves, to reach resonance with one of these waves, that is the one that corresponds to the frequency of the circuit. The result value is measured by an indicator ranged from 1 to 100. Where, the minimum value "0" represents "infinite resistances", and the maximum value "100" represents "no resistance".

As shown in FIG. 8, ideal condition was ranged from 40 to 60 of the result value. We found that body organs were improved as a whole in an example in comparison with a comparative example.

Although the present invention has been described herein with reference to the foregoing embodiments and the accompanying drawings, the scope of the present invention is defined by the claims that follow. Accordingly, those skilled in the art will appreciate that various substitutions, modifications and changes are possible, without departing from the spirit of the present invention as disclosed in the accompanying claims. It is to be understood that such substitutions, modifications and changes are within the scope of the present invention.

Particularly, it should, of course, be understood that the conductive fabric of the present invention can be used as a circuit board or a part of an electronic device although smart wear only has been mentioned throughout the specification.

The invention claimed is:

1. A textile sheet for clothes for radiating bioactive energy comprising:

a bioactive-energy radiating layer formed by coating bioactive radiant materials of silicon oxide, magnesium, aluminum, sodium, calcium, and oxidized metal; and a thermochromic unit discolored at a predetermined temperature on a surface of the bioactive-energy radiating layer and formed on a part of the bioactive-energy radiating layer.

2. The textile sheet according to claim 1, wherein the bioactive radiant materials of silicon oxide, magnesium, aluminum, sodium, calcium, and oxidized metal is mixed with a binder to be coated.

3. The textile sheet according to claim 1, wherein the binder is an acrylic-based binder.

4. The textile sheet according to claim 1, wherein the bioactive radiant materials are coated at 5% to 40% weight of the textile sheet.

5. The textile sheet according to claim 1, wherein the silicon oxide, magnesium, aluminum, sodium, calcium, and oxidized metal is included in the bioactive radiant materials in an amount of more than 0.5 weight %, respectively.

6. The textile sheet according to claim 1, wherein the thermochromic unit is formed in a shape of wave, dot, stripe, or a predetermined design.

7. The textile sheet according to claim 1, wherein the thermochromic unit has the same color as the thermochromic unit and discolored at a temperature of 10° C. to 30° C. to have different color from the bioactive-energy radiating layer.

8. The textile sheet according to claim 1, wherein the thermochromic unit has different color from the thermochromic unit and discolored at a temperature of 10° C. to 30° C. to have the same color as the bioactive-energy radiating layer.

9. The textile sheet according to claim 1, which comprises a plurality of the bioactive energy radiating layer and the thermochromic unit sequentially stacked on a surface of the textile sheet.

* * * * *